US011583742B2

(12) United States Patent
Arnold

(10) Patent No.: US 11,583,742 B2
(45) Date of Patent: Feb. 21, 2023

(54) SWING TRAINER

(71) Applicant: Arnolds Innovations Pty Ltd, Dolans Bay (AU)

(72) Inventor: Brett Arnold, Dolans Bay (AU)

( * ) Notice: Subject to any disclaimer, the term of this patent is extended or adjusted under 35 U.S.C. 154(b) by 0 days.

(21) Appl. No.: 17/266,944

(22) PCT Filed: Aug. 8, 2019

(86) PCT No.: PCT/AU2019/050833

§ 371 (c)(1),
(2) Date: Feb. 8, 2021

(87) PCT Pub. No.: WO2020/028953

PCT Pub. Date: Feb. 13, 2020

(65) Prior Publication Data

US 2021/0299538 A1 Sep. 30, 2021

(30) Foreign Application Priority Data

Aug. 8, 2018 (AU) ..... 2018902898

(51) Int. Cl.
*A63B 69/36* (2006.01)
*A63B 69/00* (2006.01)

(52) U.S. Cl.
CPC ..... *A63B 69/0059* (2013.01); *A63B 69/3632* (2013.01); *A63B 2209/10* (2013.01); *A63B 2225/09* (2013.01)

(58) Field of Classification Search
CPC ..... A63B 69/0059; A63B 69/3632; A63B 2209/10; A63B 2225/09; A63B 2102/18; A63B 2102/20; A63B 69/3608; A63B 2102/182
USPC ..... 473/205, 206, 213, 229, 276, 409, 212
See application file for complete search history.

(56) References Cited

U.S. PATENT DOCUMENTS 5,154,416 A * 10/1992 Smull ..... A63B 69/0059 473/458
5,203,568 A * 4/1993 Vasquez ..... A63B 69/0059 473/212
5,248,146 A * 9/1993 Viets ..... A63B 69/0059 473/206

(Continued)

OTHER PUBLICATIONS

International Search Report and Written Opinion issued for PCT/AU2019/050833 dated Nov. 4, 2019; 6 pages.

(Continued)

*Primary Examiner* — Nini F Legesse
(74) *Attorney, Agent, or Firm* — Bobby W. Braxton; Gregory Perrone; Braxton Perrone, PLLC

(57) ABSTRACT

A swing trainer configured to draw the elbows of the player together by the cocking of the player's wrists. The swing trainer includes arm mounts configured to mount to a player's arms at an intermediate position; and a link with at least a portion connected to the mounts and extending therebetween and arranged such that the portion of the link between the arms is configured to shorten during a swing of a stroke to inhibit splaying of the elbows of the player during the stroke, the link being slidably connected to the one of the mounts so it may slide past. A corresponding method of swing training using said swing trainer is also disclosed.

16 Claims, 11 Drawing Sheets

(56) References Cited

U.S. PATENT DOCUMENTS 5,259,621 A * 11/1993 Keefer ..... A63B 69/0059 473/212
5,501,464 A 3/1996 Dalbo
5,618,040 A * 4/1997 Parten ..... A63B 21/4019 473/464
5,816,952 A * 10/1998 Blevins ..... A63B 69/0071 473/450
5,865,685 A * 2/1999 Thomas ..... A63B 69/3608 473/213
5,904,624 A * 5/1999 Martinez ..... A63B 69/0059 473/212
6,447,402 B2 9/2002 Moran
6,863,616 B2 * 3/2005 Snyder ..... A63B 69/3608 473/214
7,033,282 B1 * 4/2006 Flood ..... A63B 69/0059 473/219
7,033,284 B2 * 4/2006 Yoshimura ..... A63B 69/3608 473/212
9,802,095 B1 * 10/2017 Boyer ..... A63B 21/4017
9,814,960 B1 * 11/2017 Bertini ..... A63B 69/3608
2002/0061786 A1 * 5/2002 Czaja ..... A63B 69/36213 473/227
2003/0148814 A1 * 8/2003 Kim ..... A63B 69/3608 473/227
2006/0003850 A1 * 1/2006 Marland ..... A63B 69/0059 473/276
2006/0150459 A1 * 7/2006 Wang ..... G09F 3/14 40/663
2015/0335975 A1 * 11/2015 Ahn ..... A63B 69/38 473/461

OTHER PUBLICATIONS

International Written Opinion issued for PCT/AU2019/050833 dated Nov. 4, 2019; 5 pages.

* cited by examiner

SWING TRAINER

CLAIM OF BENEFIT

This application is a US 371 Application from PCT/AU2019/050833 filed Aug. 8, 2019, which claims priority from AU2018902898 filed on 8 Aug. 2018, the entire contents of which are incorporated herein by referring to them in this statement.

TECHNICAL FIELD

The present technology relates generally to a swing trainer. Embodiments of the technology are particularly effective when applied to golf, but embodiments may also find effective application in baseball, softball, cricket, and other bat and/or club sports.

BACKGROUND

Club and bat sports can be challenging in general.

Golf, in particular, is difficult to master. Optimally and accurately swinging a club to hit a small ball an effective distance can be very difficult, because so many variables come into play. It is said that in a golf swing there are more than 90 variables including ball position, grip, hand position, stance, hand to lower arm angle, spine angle, club length.

Coaches have been known to observe that players, at least in the beginning of their golfing careers, find it difficult to get their arms in a useful position at a top region of a backswing.

Another observation made by coaches is that there can be seen, in beginner players, a phenomenon known as flying elbow, which is a fairly self-explanatory limiting position for the elbow.

Known training aids have not yet effectively overcome these difficulties.

The present inventor seeks to provide a new swing trainer, and/or a new swing trainer which at least provides a useful alternative to known training aids.

SUMMARY

Broadly, the present technology provides a swing trainer which in operation facilitates maintaining one or more of a player's arms in front of the player's body during at least a portion of a club or bat swing.

Broadly, the present technology, in operation, facilitates release of a player's club or bat on a downswing and through the follow through in a mechanically efficient way.

Broadly, the present technology facilitates the setting of a player's arms in an efficient position for a club swing during a stroke.

Broadly, the present technology provides a swing trainer which, during a selected portion of a good club or bat swing, draws a player's elbows together. The arrangement is such that the swing trainer is configured to be interengaged with a portion of a club or bat and at least a portion of one or more of the payer's arms so that in use changing the angle of the club relative to the arms draws at least one elbow of the player toward the other elbow. This change in angle usually occurs in a most pronounced manner at a region of the swing near the top of the backswing, but it still may occur at any point in the backswing.

In accordance with one aspect of the present technology there is provided a swing trainer including:

a plurality of arm mounts configured to mount to a player's arms at an in termediate position;

a link with at least a portion connected to the mounts and extending there between and arranged such that the portion of the link between the arms is configured to shorten during a backswing of a stroke to inhibit splaying of the elbows of the player during the stroke.

In accordance with another aspect of the present technology there is provided a swing training apparatus for improving a player's golf club swing, the swing training apparatus including:

a plurality of arm mounts configured to mount to the player's arms at an intermediate position therealong; and a link connected to the arm mounts and to the golf club, the arrangement being such that angular movement of the golf club during a backswing relative to the arms shortens the length of the link between the arms to draw the arms together at the intermediate points.

In accordance with yet another aspect of the present technology there is provided a swing training apparatus for improving a player's golf club swing, the swing training apparatus including:

a plurality of arm mounts configured to mount to the player's arms at an intermediate position therealong; and a link connected to the arm mounts and to the golf club, the arrangement being such that cocking the wrists during a backswing shortens the length of the link between the arms to draw the arms together at the intermediate points.

In accordance with one aspect of the present technology there is provided a swing trainer including:

a golf club mount;

one or more arm mounts for mounting to one or more arms at selected positions on the arm, and a flexible connector assembly fastened to the golf club mount at one end and connected to the one or more arm mounts, at least one being connected at a position remote from the golf club mount.

In one embodiment the flexible connector assembly includes at least one resilient portion.

In one embodiment the arrangement may be such that at least one of the arm mounts is connected to the flexible connector assembly in a sliding or variable position along the flexible connector assembly. In one embodiment it is an intermediate arm mount that is slidably connected to the arm mount.

In accordance with another aspect of the present invention there is provided a method of swing training which includes the steps of connecting a flexible connector assembly to a golf club mount and to one or more arms at positions remote from the golf club mount.

In accordance with a yet further aspect of the present invention there is provided a method of swing training which includes the steps of connecting a line assembly in sequence, from a golf club head to one arm and to another arm so that at a selected point in the swing the resilient line assembly draws one arm toward the other arm. In one embodiment the method includes the step of connecting the resilient line assembly to the arms near or on the elbows.

In accordance with a still further aspect of the present technology there is provided a method of swing training which includes the steps of:

extending a link between two mounts on opposed portions of a player's arms and from one mount to a club or bat from one mount, along one of the arms;

cocking the wrists to draw the arm mounts together during a stroke.

In accordance with a still further aspect of the present technology there is provided a method of swing training which includes the steps of:

using a flexible link extending between a player's arms and a club head to draw the elbows of the player together when the wrists of the player are cocked.

In accordance with a still further aspect of the present technology there is provided a method of swing training which includes the steps of:

linking the elbows of a player, together with a club head, with a flexible link;

cocking the player's wrists to shorten the flexible link, thus drawing the elbows together.

In one embodiment the link is a flexible line.

In alternative embodiments the flexible connector is an assembly which includes a resilient element such as a spring or elastic element, connected to a flexible, or rigid element.

The rigid element, if used, would be articulated either at its ends or at one or more portions along its length. There may be one or more articulating rigid elements.

The flexible line may be elastic. The resilient line may be an octopus strap. The resilient line may be an elastic rope or cord. The flexible may be an assembly which may include a rope or a sheet which is substantially inflexible. The resilient connector may have an inflexible main section with a resilient element at one end thereof.

The flexible line may be substantially inextensible.

The golf club mount may be in the form of an anchor. The golf club mount may be an articulating joint. The articulating joint may be hinged in one or more axes. The articulating joint may be a universal joint. The articulating joint may be a ball joint.

The golf club mount may include an eye or eyelet to facilitate connection thereto.

The golf club mount may include an eye or eyelet to facilitate ready connection thereto and disconnection therefrom.

The golf club mount may be mounted to the golf club at a head end of the club. The golf club mount may include a penetrating element to facilitate penetration of the end of the club. The penetrating element may be a screw element to facilitate penetration of a rubber grip at the head end of the club. The golf club mount may include a clamp to clamp to the golf club head end. There may be any suitable kind of fastener used to mount the golf club mount to the head end of the club including adhesive or other suitable fasteners.

The golf club mount may include a receiver or catch to receive the flexible or resilient connector. The receiver may be in the form of a hook or an eye or some suitable receiver element.

The arm mounts may be in the form of suitable fasteners. The arm mounts may be in the form of cuffs or sleeves for cuffing the arm at a suitable location. The cuffs or sleeves may be adjustable in diameter to suit various arm thicknesses. The cuffs may be webbing straps which may include fasteners such as hook and loop fasteners so as to close the webbing straps around the arms.

The arm mounts may include foam liners to facilitate comfortable fitting of the arm mounts to the arms.

The arm mounts may include buckles and straps to suit different diameters of arm.

The arm mounts may include hook and loop straps to facilitate ease of fastening.

The arm mounts may include one or more receivers or catch to receive the resilient connector. The receiver may be in the form of a hook or an eye or some suitable receiver element. The receiver or catch may include a guide to allow the resilient connector to slide past the arm mount, but still provide force normal to it, to draw the arm in the normal direction.

There may be provided a tensioner to vary the tension or length of the resilient connector. The tensioner may be in the form of a cleat. The tensioner may be some kind of one-way jaw device. The tensioner may be an eye with a lock to inhibit the resilient connector passing through the eye. The lock may be a rotating closure and a collet, which in use screws down and closes the eye. Similar elements may be used to suit different ergonomic outcomes as desired.

The tensioner or length adjuster may be in the form of a clutch. The clutch may be in the form of a twist lock.

Advantages

Advantageously, embodiments of the technology provide a resilient line which, at a substantially high point on a golf swing, draws the arms toward each other to inhibit elbow separation during the downswing and follow through. This provides a more efficient swing, imparting more power to the ball.

Clarifications

In this specification, where a document, act or item of knowledge is referred to or discussed, this reference or discussion is not an admission that the document, act or item of knowledge or any combination thereof was at the priority date:

(a) part of common general knowledge; or (b) known to be relevant to an attempt to solve any problem with which this specification is concerned.

It is to be noted that, throughout the description and claims of this specification, the word 'comprise' and variations of the word, such as 'comprising' and 'comprises', is not intended to exclude other variants or additional components, integers or steps.

BRIEF DESCRIPTION OF THE DRAWINGS

In order to enable a clearer understanding, a preferred embodiment of the technology will now be further explained and illustrated by reference to the accompanying drawings, in which.

DETAILED DESCRIPTION OF AN EXAMPLE EMBODIMENT

Figure 1:
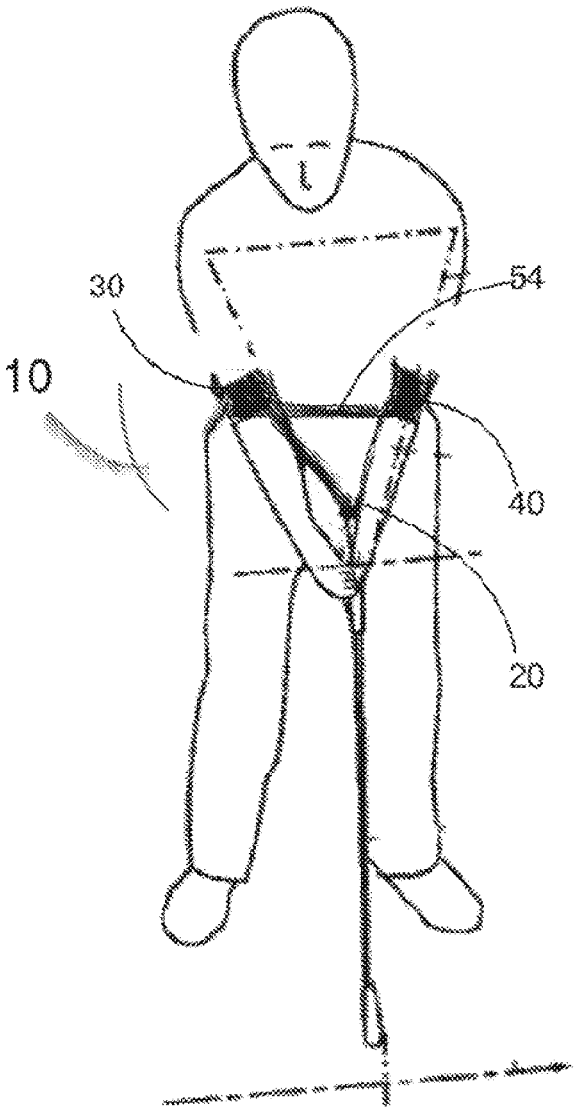
FIG. 1 is a front elevation view of a player wearing an embodiment of the technology to practice his swing, the player in position to address the ball.
Figure 2:
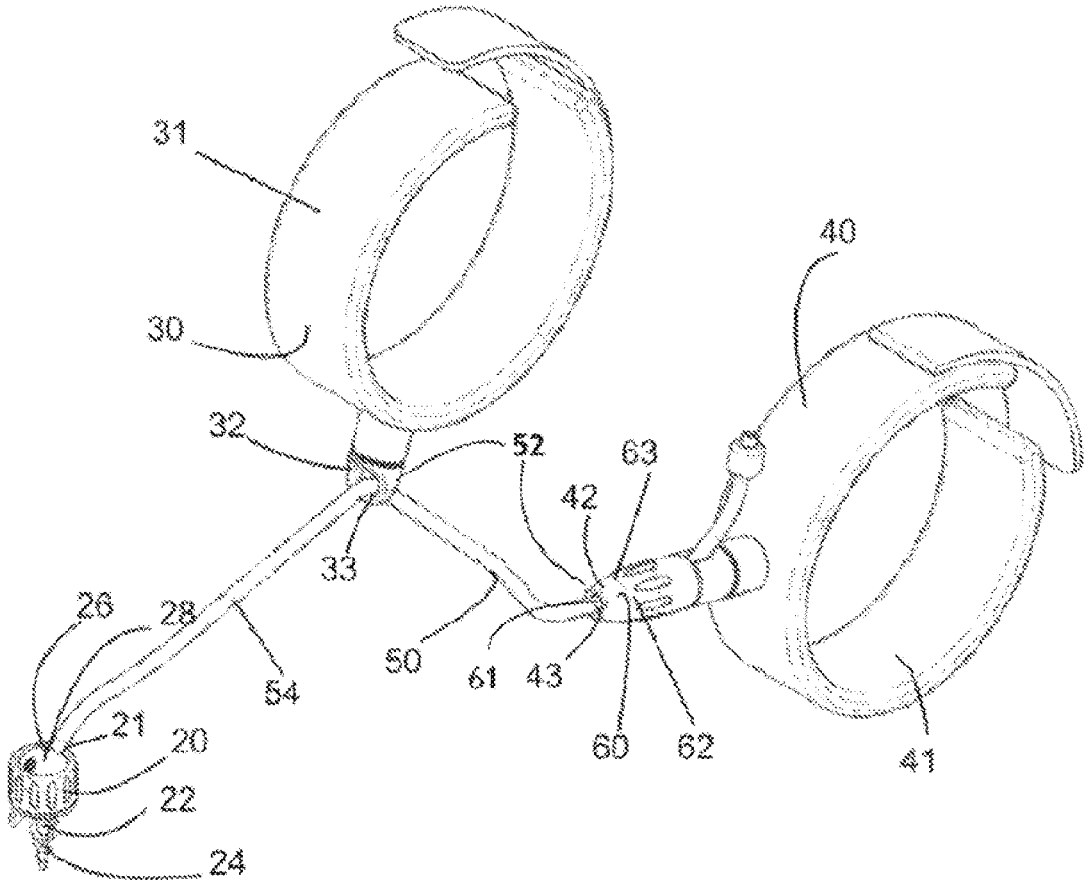
FIG. 2 is an isometric view of an embodiment of the technology.
Figure 3:
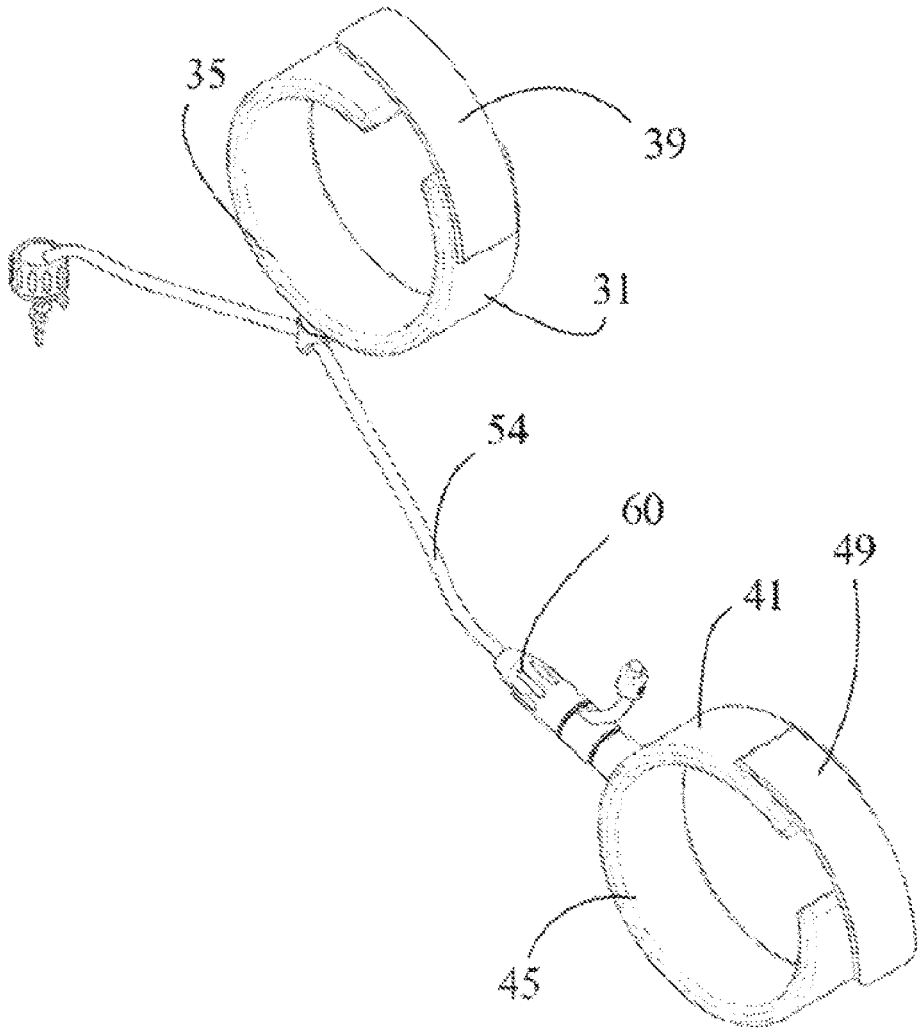
FIG. 3 is another isometric view.
Figure 4:
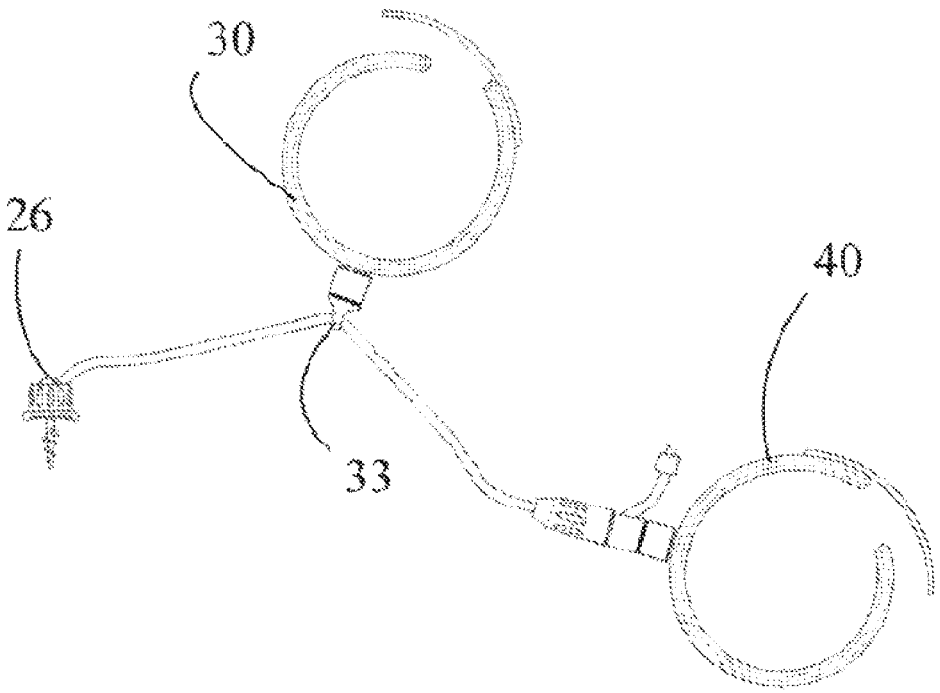
FIG. 4 is a typical side elevation view.
Figure 5:
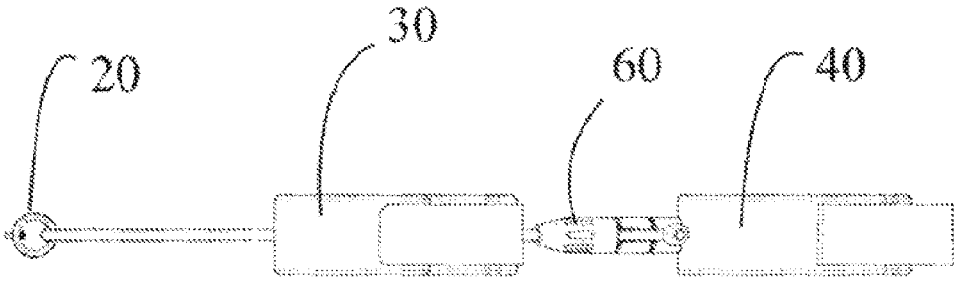
FIG. 5 is a plan view.

Referring to the drawings there is shown a first embodiment of swing trainer generally indicated at 10. The swing trainer 10 includes a golf club mount 20, and two arm mounts 30 and 40 which are configured, as shown in FIG. 1, to fasten to the arms of a user, generally in the position of the elbows, or as close to the elbows as is comfortable during a swing. It should be noted that in use, the elbows should be at least slightly free to hinge.

The swing trainer 10 also includes a flexible connector assembly 50, which may be resilient so as to form a resilient connector assembly 51 to facilitate a gentler and more ergonomic stop when the arms are drawn together during the end of the backstroke. The resilient connector assembly 51 is fastened to the golf club mount at one end 53 and to the one or more arm mounts 30 and 40 using receivers or catches shown at 52 so that the arms in use are linked to each other and to the golf head. The resilient connector is a flexible line 54, which may be in the form of an elastic rope or cord 55, such as may be seen in an octopus strap, for convenience of manufacture, light mass, durability and/or use.

The golf club mount 20 includes an anchor 22 which includes a threaded spike 24 to facilitate its fastening or mounting to the club end. Usually the club end includes a rubberised grip over a hollow club shaft, to which the threaded spike 24 may fasten. The threaded spike 24 may also "start" in a hole provided in the rubberised grip handle.

The golf club mount 20 also includes a plate 23 on which an articulating joint 26 is mounted, the articulating joint 26 being in the form of a ball and socket joint 28 so as to facilitate free rotation of the end of the club in relation to the resilient connector assembly during a cock of the wrist, which occurs during at least the top portion of the backswing.

The golf club mount 20 may also include a receiver or catch 21 to receive the resilient line 54. The receiver or catch 21 may be in the form of a hook or an eye 25 or some suitable receiver element to facilitate tying to, looping through, or swaging to, or other fastening device.

The arm mounts 30 and 40 are in the form of cuffs or sleeves 31, 41, to facilitate fastening to the arm, each one at a suitable location, such as respective elbows. The cuffs 31, 41 are straps 35, 45 made of webbing or other broad and strong textile, lined with foam 37, 47 for additional comfort. The cuffs 31, 41 also include hook and loop strap fasteners 39, 49, and a buckle so as to close the webbing straps around the arms in a variable manner, to suit various arm diameters. The arm mounts 30 and 40 are in the form of a leg or arm leash mount for a surfboard or body board, for ease of use. They are hook-and-loop-fastened cuffs.

The arm mounts 30, 40 also include one or more receivers or catches 32, 42 to receive the resilient line 54. The receiver 32 is an eye 33 so as to provide sliding connection between the flexible line 54 and the arm mount 30, while being configured to pull in a direction normal to the arm mount 30, to draw the elbow in, in use. The receiver 42 is an anchor 43 so as to anchor the other end of the flexible line 54 on the arm mount 40.

The receiver 32 and 42 are mounted on swivels, to facilitate free flow of the line 54 through the eye 33. The receivers or catches may also include ball and socket joints or other articulated joints for free movement of the line through the eye 33.

The swing trainer 10 includes a tensioner 60 to tension or shorten the flexible line 54. The tensioner 60 is the anchor 43 with a lock 62 to inhibit the resilient connector passing through the eye 61. The lock 62 is a rotating closure 63 and a collet, which in use screws down and closes the eye, to promote ergonomic use of the lock. The lock may be a cleat in the form of a jam cleat or other kind of one-way cleat.

Figure 6:
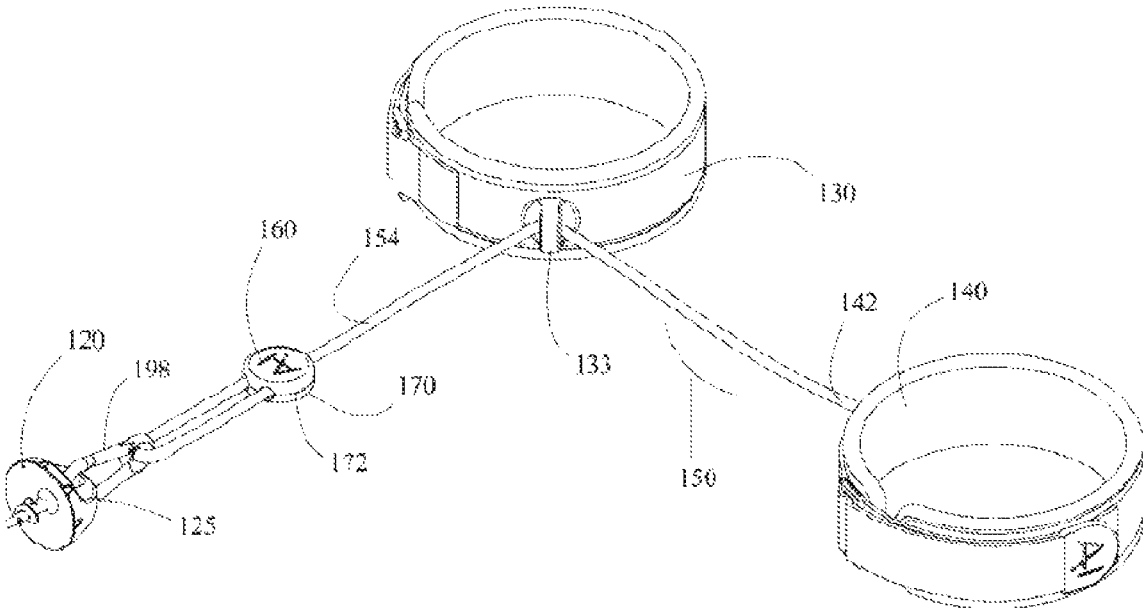
FIG. 6 is a section view.
Figure 7:
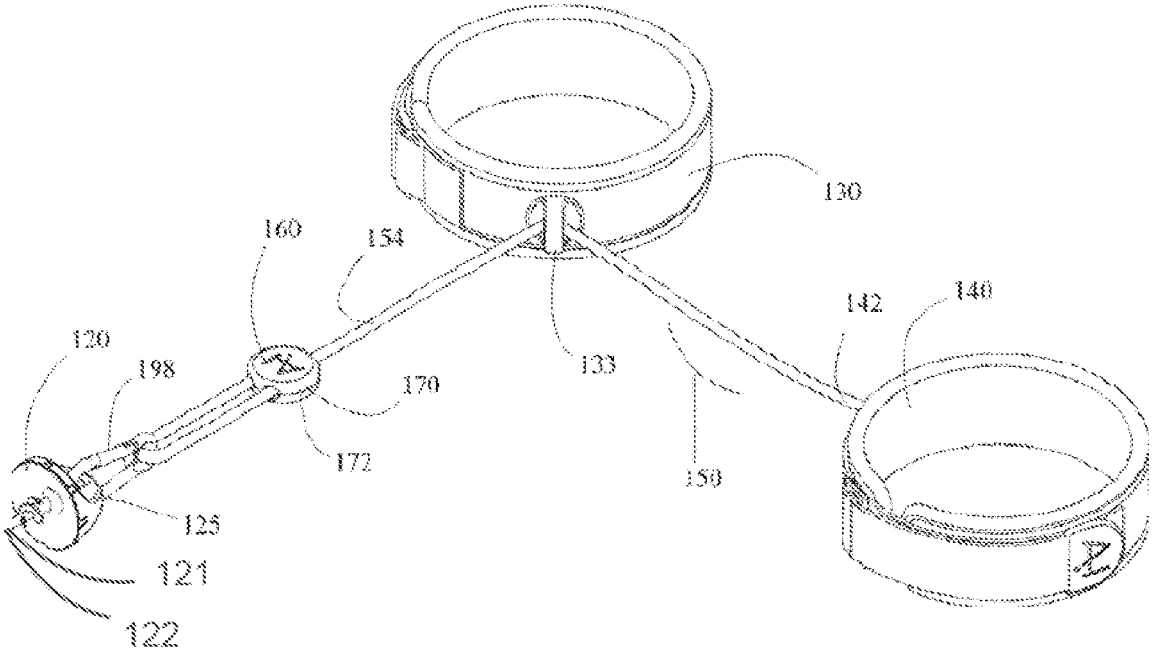
FIG. 7 is an isometric view of a second embodiment of the technology.
Figure 8:
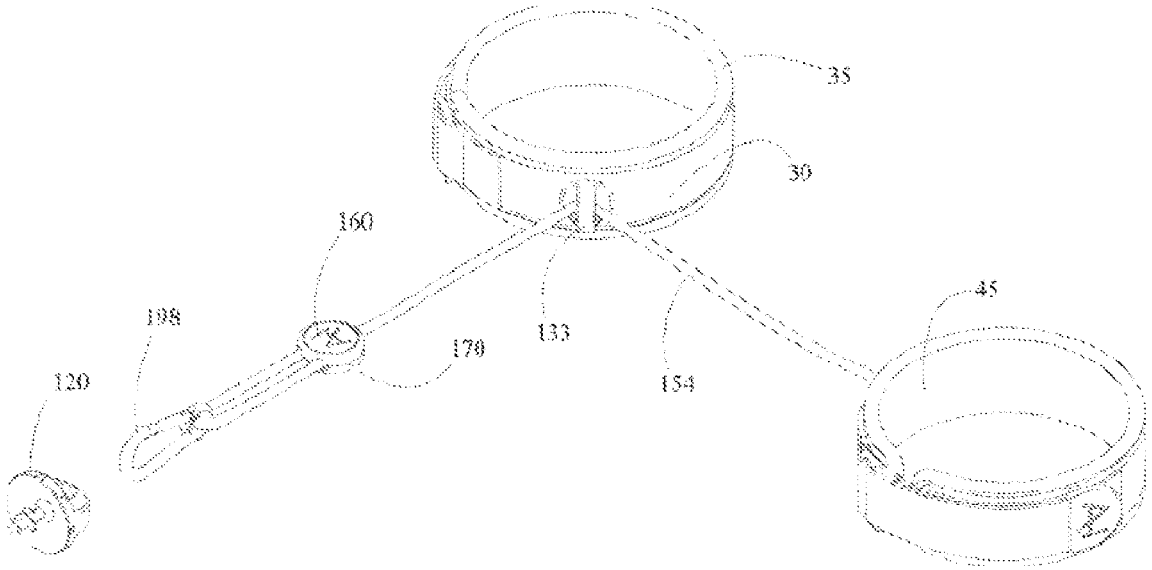
FIG. 8 is a view identical to FIG. 7 but with a golf club anchor clip undipped.
Figure 9:
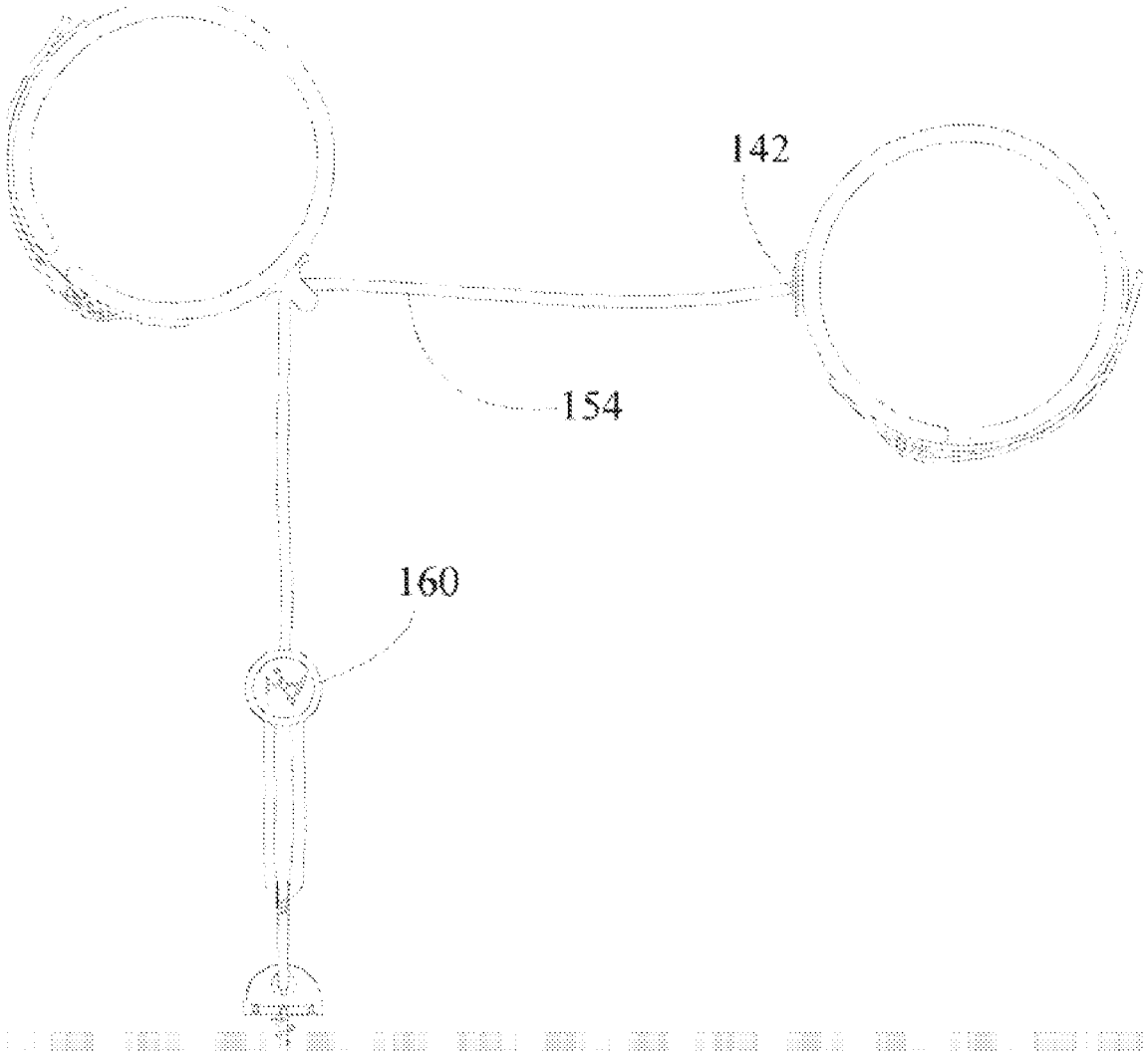
FIG. 9 is a plan view of the second embodiment.
Figure 10:
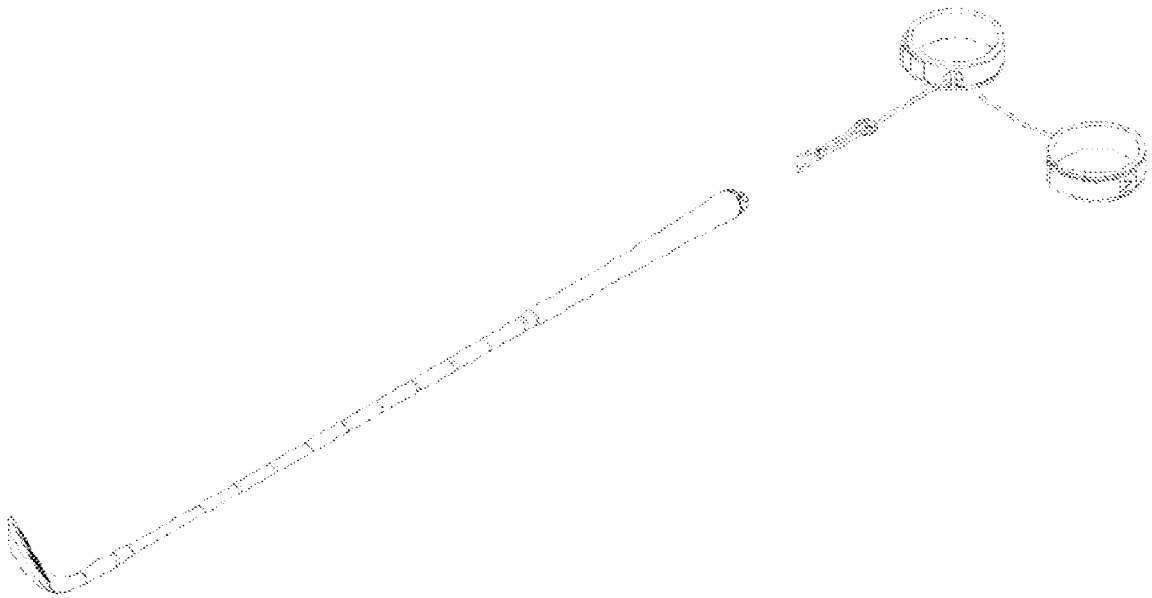
FIG. 10 is an isometric view of the second embodiment attached to a golf club.
Figure 11:
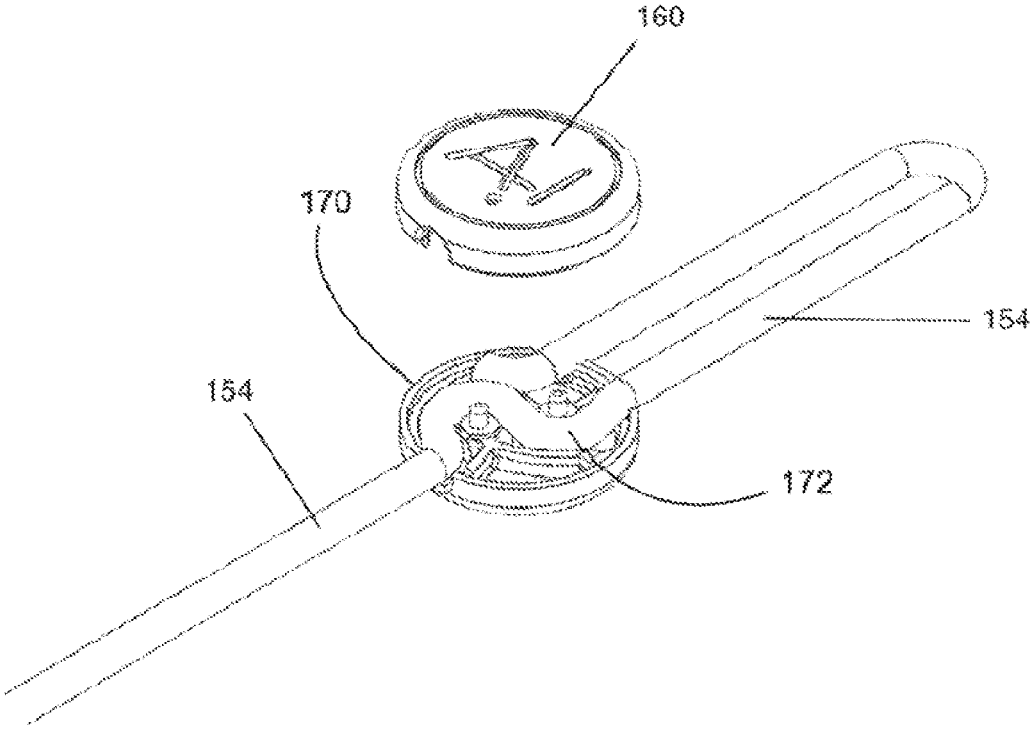
FIG. 11 is an isometric detail view of a clutch to adjust the tension/length of the flexible link.

FIG. 6 shows a section view in which it can be seen that the receiver 32 and 42 are both anchored to the arm mounts 30 and 40 by having a broad anchor portion 99 inhibiting pulling through the arm mounts.

FIGS. 7 to 10 show another embodiment of the swing trainer, generally indicated at 100. In the Figures, for efficiency of description, structures like those in FIGS. 1 to 6 are indicated with like numerals, such as 10, 100, and 20, 120 and so on.

Therefore, it can be seen that arm mounts 130 and 140 are shown, which are linked with flexible link 154 which extends from one end 142, through the eye 133 of arm mount 130 and on, when in a donned position on the player, along the right arm (of a right-handed player) to be releasably connectable via clip 198 to the eye 125 of a golf club mount 120.

The flexible line 154 assembly 150 includes a tensioner 160 which tensions or shortens in use, the flexible line 154 by twisting the clutch 170. The clutch 170 includes a pair of posts 171 which cause the flexible line 154 to extend through the clutch body 172 on a tortuous path. The path can be opened up by twisting the clutch body 172 and allowing the clutch body 172 to slide along the flexible line 154 to shorten the line 154 to a suitable length.

The clip 198 allows the player to change clubs to suit the distance of the shot desired to be played.

In operation a user dons the arm mounts 30, 40 or 130, 140 by fastening them to his or her arms, near the elbows, as shown in FIG. 1. The user then attaches the golf club mount 20, 120 to the head end of the golf club. At this time, it can be seen from FIG. 1 that the resilient line 54, 154 runs from the head end of the club, for a right-handed player, along the right arm to the elbow, and then across to the left elbow. The line 54, 154 is guided by the eye 33, 133 but can slide freely therethrough, so that the elbows may be drawn together during operation of the swing trainer 10, 110. The line 54 is anchored at the other end to arm mount 40, 140. Of course, it is to be understood that the line 54 may run along the left arm to the elbow from the head end of the club, for left-handed players.

The tensioner 60, 160, is tensioned to an appropriate level by drawing the line 54 through the eye 61 and locked off by the lock 62, or in the case of line 154, by twisting the clutch body 170 and drawing it along the line 154. An appropriate level of tension is such that there is a triangle allowed as shown in FIG. 1, when addressing the ball with the club, and when forming the triangle, there is not much tension in the line 54, but the line 54 is not loose. Finger tight, say.

The user, in use, swings the club from the position shown in FIG. 1, the address, to the back of the backswing, and finds that the elbows are constrained by the line 54. Once the wrist is cocked, usually at the top of the backswing, but sometimes before, the player feels strongly the elbow constraint, and the elbows are given an extra tension force, and pull inward toward one another, then during wearing of the trainer, and after, the player remembers that feeling and releases on the downstroke, without flaring the elbows during the stroke.

It can be understood from the drawings and description hereinbefore that the further down the club grip the player holds the club, the longer a lever arm that the end of the club makes between the player's hands and the club anchor 20, 120, and the more striking the inward drawing of the elbows will be, and be felt.

In use, the player extends a line between the elbows and down one arm to the club head so that by cocking the wrist, the club head draws the elbows of the player inward.

Clarifications

Modifications and improvements to the invention will be readily apparent to those skilled in the art. Such modifications and improvements are intended to be within the scope of this invention.

Additional Disclosure

The following clauses are offered as further description of the disclosed invention.

Clause 1. A swing trainer configured, when worn by a player and connected to a club or bat handle, to draw the elbows of the player together by the cocking of the player's wrists.

Clause 2. The swing trainer in accordance with claim 1 further configured to be interengaged with a portion of a club or bat and at least a portion of the arms of the player, so that in use, changing the angle of the club or bat relative to the arms draws at least one elbow of the player toward the other elbow.

Clause 3. The swing trainer in accordance with claim 1 or 2 including:

a plurality of arm mounts configured to mount to a player's arms at an intermediate position;

a link with at least a portion connected to the mounts and extending therebetween and arranged such that the portion of the link between the arms is configured to shorten during a swing of a stroke to inhibit splaying of the elbows of the player during the stroke.

Clause 4. The swing trainer in accordance with any one of claims 1 to 3 wherein the link is flexible.

Clause 5. The swing trainer in accordance with claim 4 wherein the flexible link includes at least one resilient portion.

Clause 6. The swing trainer in accordance with any one of claim 4 or 5 wherein the flexible link is connected to the arm mount in a sliding or variable fashion.

Clause 7. The swing trainer in accordance with any one of claim 4, 5, or 6 wherein the flexible link is an assembly which includes one or more articulating rigid elements.

Clause 8. The swing trainer in accordance with any one of claims 4 to 7 wherein the flexible link is an octopus strap.

Clause 9. The swing trainer in accordance with any one of claims 4 to 8 wherein the flexible link includes a rope.

Clause 10. The swing trainer in accordance with any one of claims 1 to 9 wherein the golf club mount is in the form of an anchor.

Clause 11. The swing trainer in accordance with any one of claims 1 to 10 wherein the golf club mount includes an articulating joint.

Clause 12. The swing trainer in accordance with any one of claims 1 to 11 wherein the golf club mount includes an eye or eyelet to facilitate connection thereto.

Clause 13. The swing trainer in accordance with any one of claims 1 to 12 wherein golf club mount is configured to be mounted to the golf club at a head end of the club.

Clause 14. The swing trainer in accordance with any one of claims 1 to 13 wherein the golf club mount includes a penetrating element to facilitate penetration of the end of the club.

Clause 15. The swing trainer in accordance with claim 14 wherein the penetrating element includes a screw element to facilitate penetration of a rubber grip at the head end of the club.

Clause 16. The swing trainer in accordance with any one of claims 1 to 15 wherein the club mount includes a clamp to clamp to the golf club head end.

Clause 17. The swing trainer in accordance with any one of claims 1 to 16 wherein the arm mounts are in the form of cuffs or sleeves for cuffing the arm at a suitable location.

Clause 18. The swing trainer in accordance with claim 17 wherein the cuffs or sleeves are adjustable in diameter to suit various arm diameters.

Clause 19. The swing trainer in accordance with any one of claim 17 or 18 wherein the cuffs are webbing straps with fasteners such as hook and loop fasteners so as to close the webbing straps around the arms.

Clause 20. The swing trainer in accordance with any one of claims 1 to 19 wherein the arm mounts include foam liners to facilitate comfortable fitting of the arm mounts to the arms.

Clause 21. The swing trainer in accordance with any one of claims 1 to 20 wherein the arm mounts include buckles and straps to suit different diameters of arm.

Clause 22. The swing trainer in accordance with any one of claims 1 to 21 wherein the arm mounts include one or more receivers or catch to receive the resilient connector.

Clause 23. The swing trainer in accordance with claim 22 wherein the receiver may be in the form of a hook or an eye.

Clause 24. The swing trainer in accordance with any one of claims 1 to 23 wherein there is provided a tensioner to vary the tension or length of the resilient connector. The tensioner may be in the form of a cleat.

Clause 25. The swing trainer in accordance with claim 24 wherein the tensioner or length adjuster is in the form of a clutch.

Clause 26. A method of swing training which includes the steps of:

extending a link between two mounts on opposed portions of a player's arms and from one of the mounts to a club or bat, along one of the arms, the link being slidably connected to the one of the mounts so it may slide past;

cocking the wrists to draw the arm mounts together during a stroke.

The invention claimed is:

1. A swing trainer comprising:

a first and second arm mount configured to mount to a player's separate arms at an intermediate position along the arms, wherein at least one of the first and second arm mounts includes an eye or a hook for slidably connecting a flexible link;

a golf club mount configured to connect to a handle end of a golf club, a flexible link extending between the golf club mount and through at least the eye or hook on the first or second mounts, to the other of the first or second mounts;

such that a portion of the flexible link between the first and second arm mounts is shortened when the player's wrist cocks during a swing of a stroke, to inhibit splaying of the elbows of the player during the stroke;

wherein said golf club mount comprises an articulating joint.

2. The swing trainer of claim 1 wherein said link includes at least one elastic portion.

3. The swing trainer of claim 1 wherein said link is a chain assembly.

4. The swing trainer of claim 1 wherein said link is strap or rope.

5. The swing trainer of claim 1 wherein the golf club mount is an anchor.

6. The swing trainer of claim 5 wherein the anchor includes a clamp to clamp to the golf club handle end.

7. The swing trainer of claim 1 wherein the golf club mount includes an articulating joint.

8. The swing trainer of claim 1 wherein the golf club mount includes an eye or eyelet to facilitate connecting the flexible link to the golf club mount.

9. The swing trainer of claim 1 wherein the golf club mount includes a penetrating element to facilitates penetration of the penetrating element into the handle end of the club.

10. The swing trainer of claim 9 wherein the penetrating element includes a screw element.

11. The swing trainer of claim 1 wherein each of said first and second arm mounts are cuffs or sleeves for cuffing the arm at a suitable location.

12. The swing trainer of claim 11 wherein the cuffs or sleeves are adjustable in diameter to suit various arm diameters.

13. The swing trainer of claim 1 further including a tensioner or length adjuster to adjust the tension or length of the flexible link.

14. The swing trainer of claim 13 wherein the tensioner or length adjuster is of a clutch which can be rotated on the link to release and lock.

15. The swing trainer of claim 13 wherein the tensioner includes a cleat.

16. A method of swing training which includes the steps of:

mounting a flexible link to a first arm mount;

extending the flexible link through an eye on a second arm mount;

extending the link along one of the arms from the eye to a handle-end mount on a club or bat cocking a user's wrists to increase tension in a portion of the flexible link extending along the arm to draw the arm mounts together during a stroke.

* * * * *